US005213162A

United States Patent [19]

Iato

[11] Patent Number: 5,213,162

[45] Date of Patent: May 25, 1993

[54] SUBMARINE WELLHEAD

[75] Inventor: Midel Iato, Pau, France

[73] Assignee: Societe Nationale Elf Aquitaine (Production), France

[21] Appl. No.: 835,554

[22] Filed: Feb. 14, 1992

[30] Foreign Application Priority Data

Feb. 14, 1991 [FR] France ..... 91 01723

[51] Int. Cl.[5] ..... E21B 33/043

[52] U.S. Cl. ..... 166/341; 166/344; 166/365; 166/368; 166/65.1

[58] Field of Search ..... 166/65.1, 338–341, 166/344, 365, 368

[56] References Cited

U.S. PATENT DOCUMENTS

| | | | |
|---|---|---|---|
| 3,295,600 | 9/1963 | Brown et al. | 166/0.5 |
| 3,305,015 | 9/1963 | Brown et al. | 166/0.6 |
| 3,414,056 | 12/1968 | Brown et al. | 166/89 |
| 3,592,263 | 7/1971 | Nelson | 166/0.5 |
| 3,595,311 | 7/1971 | Harbonn | 166/0.5 |
| 3,638,732 | 2/1972 | Huntsinger et al. | 166/315 |
| 3,921,500 | 11/1975 | Silcox | 166/338 X |
| 4,003,428 | 1/1977 | Zehren | 166/341 |
| 4,331,203 | 5/1982 | Kiefer | 166/360 X |
| 4,391,330 | 7/1983 | Kiefer | 166/378 X |
| 4,770,248 | 9/1988 | Houlgrave et al. | 166/341 |
| 5,052,941 | 10/1991 | Hernandez-Marti et al. | 166/65.1 X |

FOREIGN PATENT DOCUMENTS

| | | |
|---|---|---|
| 0374016A3 | 6/1990 | European Pat. Off. . |
| WO86/01852 | 3/1986 | World Intl. Prop. O. . |

*Primary Examiner*—Thuy M. Bui
*Assistant Examiner*—Roger J. Schoeppel
*Attorney, Agent, or Firm*—Bacon & Thomas

[57] ABSTRACT

A submarine wellhead (10) for producing wells, including a hollow body (14) mounted in a water-tight fashion on a well (16) configured to receive a suspension device (30) equipped with a production column (26) designed to be lowered down into the well, which body (14) is also equipped with an outlet port (20) for the oil coming up from the well through the production column (26), hydraulic flow between the production column (26) and the outlet port (20) occurring through the suspension device (30), and hydraulic flow being ensured regardless of the rotation position of the suspension device (30) in relation to the body (14).

5 Claims, 2 Drawing Sheets

SUBMARINE WELLHEAD

BACKGROUND OF THE INVENTION

1. Technical Field of the Invention

The present invention relates to a submarine wellhead, and, more specifically, to a wellhead designed for use on an producing well in a low pressure oil field.

2. Description of the Prior Art

When an submarine oil field goes into production, several wells, spaced out over the surface of the oil field, are connected to a central production platform by means of pipes laid on the ocean floor. Each well is equipped with a wellhead which ensures the watertightness of the well and has one or more safety valves.

In some oil fields, oil pressure on the wellhead is low and may even be lower than the pressure on the ocean floor, In order to place into production a field of this type, in which the oil does not flow naturally, a pump must be installed, for example at the bottom of the production column.

The traditional method generally uses a centrifugal electric pump, which requires laying an electrical cable between a source, usually mounted on the central platform, and the pump motor. Since it is used in a corrosive environment, the pump has a life of about one year. When the pump breaks down, it is necessary to disconnect the wellhead, pull up the production column holding the pump, replace the pump and then reinstall the production column and the wellhead. This complex and therefore costly operation is further complicated by the need to reestablish the electrical connection to ensure hydraulic flow between the production column and the production line at the wellhead outlet port.

SUMMARY OF THE INVENTION

Therefore the object of the present invention is a submarine wellhead of simple and reliable construction which simplifies the operation of changing the pump on the bottom of the production column.

In order to accomplish this, the invention proposes a submarine wellhead for producing wells including a hollow body mounted in a watertight fashion on a well configured to receive a suspension device equipped with a production column designed to be lowered down into the well, which body is also equipped with an outlet port for the oil coming up from the well through the production column, hydraulic flow between the production column and the outlet port occurring through the suspension device, hydraulic flow being ensured regardless of the rotation position of the suspension device in relation to the body.

Other characteristics and advantages of the present invention will become clearer on reading the description given below as an example.

BRIEF DESCRIPTION OF THE FIGURES OF DRAWINGS

The description refers to the attached drawings in which FIG. 1 is a longitudinal section view of a wellhead according to the invention and FIG. 2 is a longitudinal section view of the wellhead during a pump change.

DETAILED DESCRIPTION OF THE PREFERRED EMBODIMENT

Figure 1:
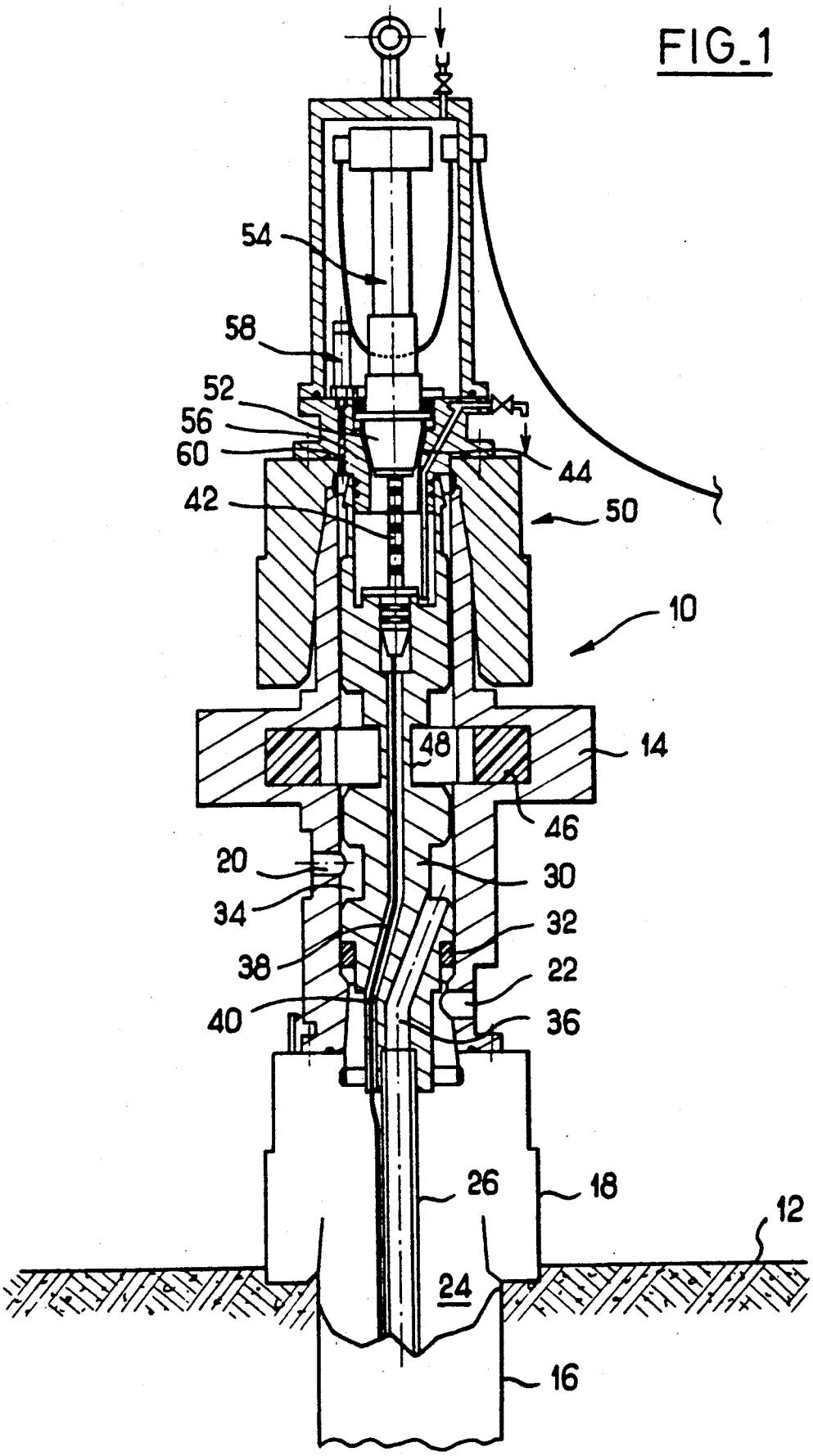

AS shown in FIG. 1, a submarine wellhead, generally represented by 10, is laid on the ocean floor 12. The wellhead 10 includes a somewhat tube-shaped body 14, mounted on an oil well (16) in a water-tight fashion by means of a base (18). The body (14) is fitted with an oil outlet port (20) designed to be connected to an oil pipe (not shown) and an inlet port (22) connecting to the annular space (24) between the well casing (16) and the production column (26).

The production column (26) is attached in a stationary manner to the bottom of the production column suspension device (30), mounted inside the body (14). The device (30) is equipped with an annular joint 32 which separates the inside of the body (10) from annular space (24). Inlet port (20) connects with the inside of the production column (26) through an annular space (34) between the device (30) and the body (10), through a pathway incorporated in the body (14). In addition, device (30) includes a path (38) through which an electrical cable (40) is run in order to feed a pump (not shown) mounted on the bottom end of the production column (26). The end of the cable (40) is connected to the male element (42) of a cylindrical-type electrical connector (44).

The body (14) is equipped with a radial-action safety valve (46) which fits into an annular groove (48) in the production column suspension device (30), forming the inside of the body (10). A detachable locking unit, usually represented as 50, is mounted on the body (14) and includes the female part (52) of the electrical connector (44). The locking unit (50), the body (14) and the device (30) are coaxial; the locking unit (50) includes a hydraulic activator (54) which moves the female part (52) to establish an electrical connection with the male element (42) of the electrical connector (44). The locking unit (50) includes in addition an annular ring (56) on which is mounted a pressure sensor (58) for measuring the prevailing pressure at the production column outlet port (26), through a path (60) and the inside of the body (14). It should be noted that the device (30) is mounted on the inside of the body (14) with a predetermined play.

Figure 2:
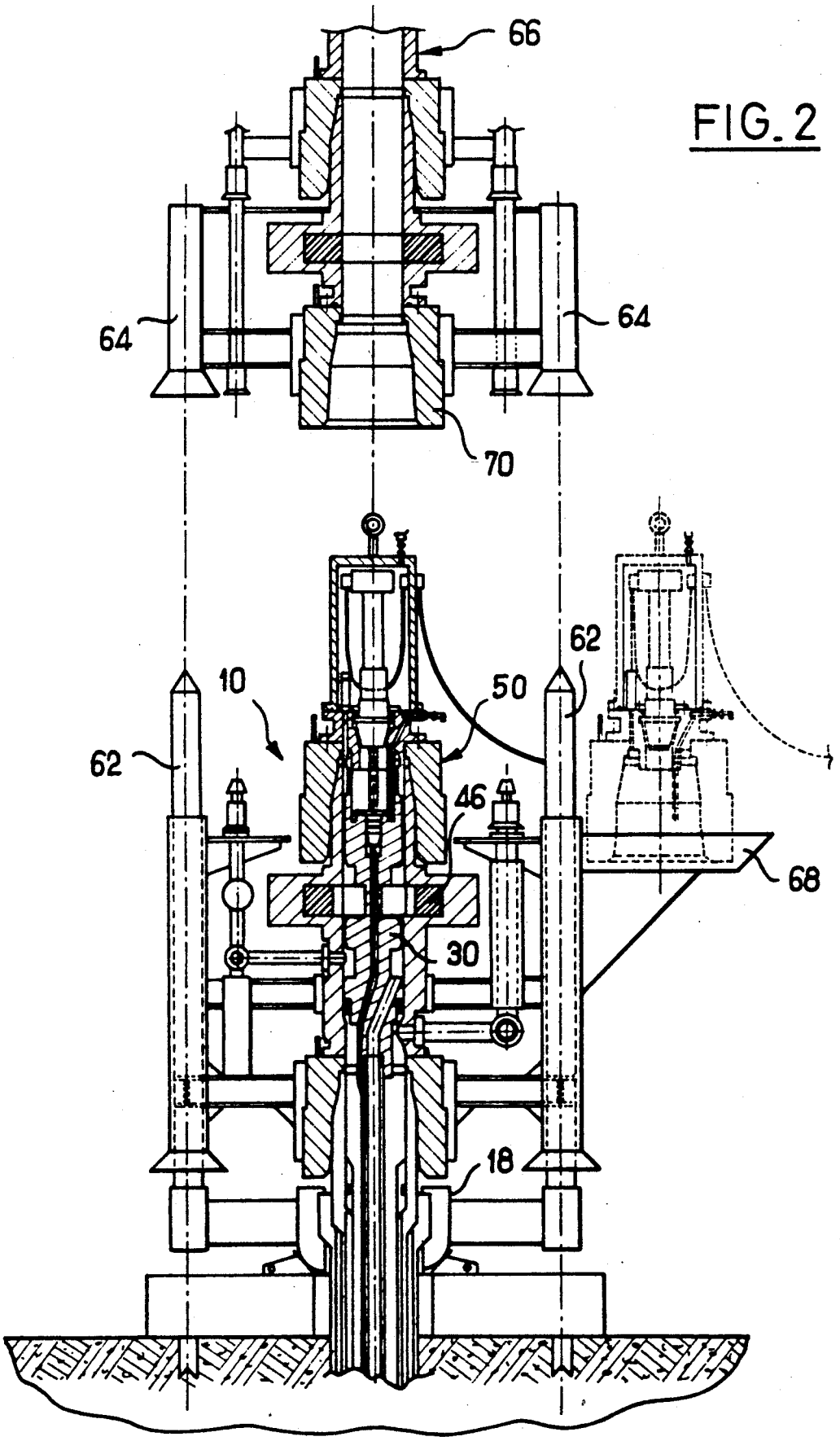

The mounting and dismantling of the wellhead (10) will now be described with reference to FIG. 2. Arranged around the wellhead 10 are mounting rods (62) designed to receive guide and mounting tubes (64) arranged around the lower end of an extension tube (66), more commonly known as a riser. When a malfunction occurs in the pump mounted on the bottom of the production column (26), a pump change is made by first closing safety valve (46). With the inside of the body (14) thus sealed off, the male and female elements of the electrical connector (44) are disconnected and the locking unit (50) can be pulled out. A place (68) is provided on one of the mounting rods (62) to hold the locking unit (50) after removal from the wellhead (10). This position is shown in FIG. 2 in dotted lines.

The lower end of the riser (66) has an annular flange (70) approximately the same shape as the locking unit (50). The riser (66) is lowered on to the wellhead (10) so that the guide tubes (64) come down over the mounting rods (62), and the annular flange (70) fastens onto the body (14) at the location of the locking unit (50). The safety valve (46) is then reopened, making it possible to take out the malfunctioning pump through the inside of the riser (66), the suspension device (30) and the production column (26). The pump is then replaced and the entire apparatus, including the device (30), the production column (26) and the pump, is lowered back down into the wellhead (10).

One feature of the invention is that the symmetrical shape of the device (30) and the presence of the annular space (34), preclude the need to adjust the device (30) in the body (14), since hydraulic flow between the production column and the outlet port (20) is established automatically.

Once the device (30) has been put back inside the body (14), the safety valve (46) is closed prior to removing the riser (66) and replacing the locking unit (50). The symmetrical shape of the locking unit (50) as well as the location of the electrical connector (44) on the longitudinal axis of the wellhead (10) also preclude the need to adjust the position of the locking unit (50) on the body (14).

In order to be certain the new pump is operating when installed, an electrical feed can be installed inside the riser (66). This makes it possible to check the operation of the pump before replacing the locking unit (50).

Thus the present invention represents a simplified means of installing and replacing wellheads without having to adjust the components beforehand.

I claim:

1. Submarine wellhead for producing wells comprising a hollow body mounted in water-tight fashion on a well and configured to receive a suspension device equipped with a production column designed to be lowered into the well, which body is also equipped with an outlet port for the oil coming up from the well through the production column, hydraulic flow between the production column and the outlet port occurring through the suspension device, with hydraulic flow being ensured regardless of the rotation position of the suspension device with respect to the body, and further comprising a locking unit mounted on one open end of the body, with the locking unit having an approximately annular shape which makes it possible to mount it on the body regardless of the relative rotation position of the locking unit with respect to the body.

2. A wellhead according to claim 1, wherein the hydraulic path is formed partly by an annular space defined by the suspension device and the body.

3. A wellhead according to claim 2, wherein the body is somewhat tube-shaped, and the suspension device has a somewhat cylindrical shape, with the annular space being defined by the inside of the body and a portion, and a narrow section of the suspension device.

4. A wellhead according to claim 1, further comprising an electrical cable which feeds a pump installed at the bottom of the production column; the wellhead also being equipped with an electrical connector, of which one part is mounted on the suspension device, and the other part on the locking unit.

5. A wellhead according to claim 4, wherein the electrical connector is approximately cylindrical in shape, with the body, the suspension device, the locking unit and the electrical connector being arranged coaxially.

* * * * *